US007275354B2

(12) United States Patent
Frievalt et al.

(10) Patent No.: US 7,275,354 B2
(45) **Date of Patent: *Oct. 2, 2007**

(54) VERTICAL FORM, FILL AND SEAL PACKAGING SYSTEM

(75) Inventors: Curt A. Frievalt, Green Bay, WI (US); Brian E. Kettner, Appleton, WI (US)

(73) Assignee: CMD Corporation, Appleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/296,752

(22) Filed: Dec. 7, 2005

(65) Prior Publication Data

US 2006/0144021 A1 Jul. 6, 2006

Related U.S. Application Data

(63) Continuation-in-part of application No. 11/102,125, filed on Apr. 8, 2005, which is a continuation-in-part of application No. 11/030,551, filed on Jan. 5, 2005.

(51) Int. Cl.
*B65B 61/18* (2006.01)
*B65B 9/20* (2006.01)

(52) U.S. Cl. ..... 53/412; 53/451; 53/133.4; 53/139.2; 53/551

(58) Field of Classification Search ..... 53/412, 53/133.4, 139.2, 450, 451, 545, 546, 548, 53/550–552, 413, 134.1; *B65B 9/06, 9/10, B65B 61/16*

See application file for complete search history.

(56) References Cited

U.S. PATENT DOCUMENTS 2,200,971 A * 5/1940 Sonneborn et al. ..... 53/410
2,385,897 A * 10/1945 Waters ..... 53/134.1
2,565,444 A * 8/1951 Waters ..... 53/511
3,008,278 A * 11/1961 McCalley ..... 53/551
3,481,099 A * 12/1969 Clancy ..... 53/429
3,924,383 A * 12/1975 Heger ..... 53/410
4,566,252 A * 1/1986 Watanabe et al. ..... 53/410
5,826,401 A * 10/1998 Bois ..... 53/412
6,519,922 B1 2/2003 Matheyka et al.
6,679,034 B2 1/2004 Kohl et al.
6,691,491 B2 2/2004 Terminella et al.
6,732,491 B2 * 5/2004 Buchman ..... 53/412

(Continued)

FOREIGN PATENT DOCUMENTS

GB 2354969 A 10/1999

(Continued)

*Primary Examiner*—Stephen F. Gerrity
(74) *Attorney, Agent, or Firm*—George R. Corrigan

(57) ABSTRACT

A method and apparatus for continuously or intermittently and vertically forming, filling and sealing packaging includes an infeed section, a pleating assembly, a forming tube and a sealing assembly. The pleating assembly imparts at least one pleat to the film. The film may be driven and measured at a nip following the pleating. The forming tube receives the film from the infeed section after the pleat has been made. A film tube is formed about the forming tube. The film tube is vertically fed downward to the sealing assembly which imparts seals to the film tube, thereby forming packages. A hole punch punches holes in the film tube. The film travels a film path that includes the hole punch, the forming tube, the vertical seal assembly and the horizontal seal assembly.

25 Claims, 4 Drawing Sheets

U.S. PATENT DOCUMENTS

| | | | | |
|---|---|---|---|---|
| 6,941,722 | B2 * | 9/2005 | Kinigakis et al. | 53/133.4 |
| 2002/0124535 | A1 * | 9/2002 | Peroni et al. | 53/551 |
| 2003/0179957 | A1 * | 9/2003 | Tankersley | 383/10 |
| 2004/0088948 | A1 * | 5/2004 | Yamamoto et al. | 53/134.1 |
| 2005/0014623 | A1 | 1/2005 | Van De Kruys et al. | |
| 2005/0069230 | A1 * | 3/2005 | Takahashi et al. | 383/104 |

FOREIGN PATENT DOCUMENTS

| | | | | |
|---|---|---|---|---|
| GB | 2354971 | A | | 10/1999 |
| GB | 2357991 | A | | 1/2000 |
| JP | 64-37305 | A | * | 2/1989 |
| JP | 2002-205717 | A | * | 7/2002 |
| JP | 2004115082 | A | * | 4/2004 |
| WO | WO 89/00949 | | * | 2/1989 |
| WO | WO 01/24999 | | | 4/2001 |
| WO | WO 03/055760 | A1 | * | 7/2003 |

* cited by examiner

VERTICAL FORM, FILL AND SEAL PACKAGING SYSTEM

RELATED APPLICATION

This new application is a continuation-in-part of, and claims the benefit of the filing date of, U.S. patent application Ser. No. 11/102,125, filed Apr. 8, 2005, entitled Vertical Form, Fill and Seal Packaging System, which is a continuation-in-part of, and claims the benefit of the filing date of, U.S. patent application Ser. No. 11/030,551, filed Jan. 5, 2005, entitled Vertical Form, Fill and Seal Packaging System.

FIELD OF THE INVENTION

The present invention relates generally to the art of pouch machines. More specifically, it relates to machines wherein pouches are formed from a continuously or intermittently moving film.

BACKGROUND OF THE INVENTION

Vertical form fill and seal continuous and intermittent pouch machines are known in the art. Generally, they receive a continuous film and form the film into a film tube (i.e., the film is formed and sealed to have a closed cross section) about a forming tube. The forming tube typically has a circular or oval cross section, although other cross sections have been used. The film is continuously or intermittently fed around the forming tube and sealed vertically to form the film tube. The vertical seal is typically a lap seal or a fin seal.

Forming tubes can include ploughs or tucker bars to form pleats or creases that can be used to form gussets, to make stand-up pouches. The plough or tucker bar applies tension in an inward direction creasing the film tube. Forming plates may be provided on either side of the plough, applying tension in an outward direction. Two ploughs centered about a single tucker bar will form a "W" shaped gusset. The ploughs and tucker bars may be fixed in one location, such as at the bottom of the forming tube, or moveable in any direction. Examples of a tucker bar and forming plates may be seen in U.S. Pat. No. 6,679,034, hereby incorporated by reference. Tucker bars (and forming plates) may be used on a single side of the pouch, forming one gusset, or on opposing sides, forming two gussets. Forming tube assemblies may be changed out to form bags of other sizes. Another prior art machine is shown in U.S. Pat. No. 6,691,491, hereby incorporated by reference.

After the film tube passes the forming tube and tucker bar(s) it moves vertically downward to a sealing zone. Seal bars intermittently create a horizontal seal. The seal bars may be rotary, and can be in pairs to increase machine speed. An example of seal bars is given in U.S. Pat. No. 6,519,922, hereby incorporated by reference.

The horizontal seal forms the top seal of the pouch below the seal, and the bottom of the pouch above the seal. After the seal is formed a scale or other input device drops a predetermined amount of product through the forming tube. At the same time the film tube is advancing downward. When the subsequent seal is formed the product is below the sealing zone. The seal is formed, forming the top seal of the filled pouch and the bottom seal of the pouch above, thus sealing the product into the pouch. Stripper bars, such as those shown in U.S. Pat. No. 6,519,922 may be used to help ensure the product is below the sealing zone when the seal is made.

Different types of pouches may be formed with vertical form filling seal continuous packaging machines, such as pillow bags, stand up pouches, other pouches, etc. Standup pouches are typically formed with a gusset at (what will be) the bottom of the pouch using ploughs and a tucker bar as described above. For example, a pouch made on a vertical pouch machine may have a gusset put on one vertical edge of the pouch. However, when the pouches are separated from one another they are rotated 90 degrees so that what had been the vertical edge (with the gusset) of a pouch becomes the bottom edge of the pouch. The standup pouches look and perform well when one seal is placed at the bottom of each of the outer folds of the gusset. (The gusset is usually formed to be a "W" with the outer folds being the folds the pouch stands on.) However, prior art machines have not been able to reliably place a seal and typically tried to create the seal as the gusset is being formed. It is difficult with such an arrangement to change features of the pleat, such as depth or location, the entire forming assembly was changed out. Accordingly, a vertical form fill and seal pouch machine that provides a gusset with a pleat and seal on the outer folds of the gusset is desirable. Also, such a pleat should be easily adjustable.

When forming a seal on the bottom of the gusset, a pleat may be formed to locate the seal. However, the film can be difficult to crease without damaging the film. Accordingly, a vertical form fill and seal pouch machine that provides for pleating the film without damaging it is desirable.

Stand up pouches are typically formed such that the two sides of the gusset are equal in length. This results in a bag that stands upright. However, other gusset designs may be useful, such as one where the backside of the gusset is shorter than the front side, so that the pouch tilts away from the consumer or on the shelf. It is desirable to be able to control the depth and location of pleats and seals used to form a gusset, so that the gusset is thereby adjustable. Accordingly, a vertical, form fill and seal pouch machine that provides for adjustable seals and pleats on the gusset is desirable.

Standup pouches and are sometimes displayed to the consumer by hanging them from a rod through a hanger hole punched in the top of the pouch. Holes have been punched in pouches using horizontal machines and using intermittent vertical machines. It is desirable to provide a hole punch in continuous vertical machines, but thus far a hole punch that may be operated fast enough and with sufficient accuracy has not been available. Accordingly, in continuous vertical form fill and seal machine that provides a hole punch in what will be the top of a pouch is desirable.

SUMMARY OF THE PRESENT INVENTION

According to a first aspect of the invention a vertical, form, fill and seal packaging machine includes an infeed section, a pleating assembly, a forming tube and a sealing assembly. The pleating assembly imparts at least one pleat to the film. The forming tube receives the film from a driven or measured nip after the pleat has been made. A film tube is continuously formed about the forming tube. The film tube is vertically fed downward to the sealing assembly which imparts seals to the film tube, thereby forming packages.

According to a second aspect of the invention a method of vertically forming, and sealing packages includes feeding film and imparting at least one pleat to the film. The pleated film is provided to a forming tube from a driven or measured nip and vertical seals are made on the film, thereby forming a film tube. A series of horizontal seals are made to form packages.

A pleat sealing assembly is disposed to receive the film after it passes through the pleating assembly and it seals the at least one pleat in another embodiment. The pleat is sealed prior to the film being received by the forming tube in various embodiments.

The pleating assembly and/or the pleat sealing assembly are in the infeed section in other embodiments.

The pleating assembly includes at least two pleaters to form at least two pleats in other embodiments.

Each pleater may include an adjustable shoe and a fixed plate in various embodiments.

User controls for pleat depth adjustment, and/or cross-machine pleat location, and\or pleat separation are provided and operatively connected to the pleating assembly in various embodiments.

The forming is intermittent in some embodiments and continuous in other embodiments.

The hole punch creates a hanging chad that may have an attached portion of the chad on a leading edge of the hole in other embodiments.

The hole punch is located on the film path after the forming tube and vertical seal assembly, but before the horizontal seal assembly in one embodiment.

Product is intermittently provided through the forming tube, to fill each package between the horizontal seals.

Other principal features and advantages of the invention will become apparent to those skilled in the art upon review of the following drawings, the detailed description and the appended claims.

Figure 1:
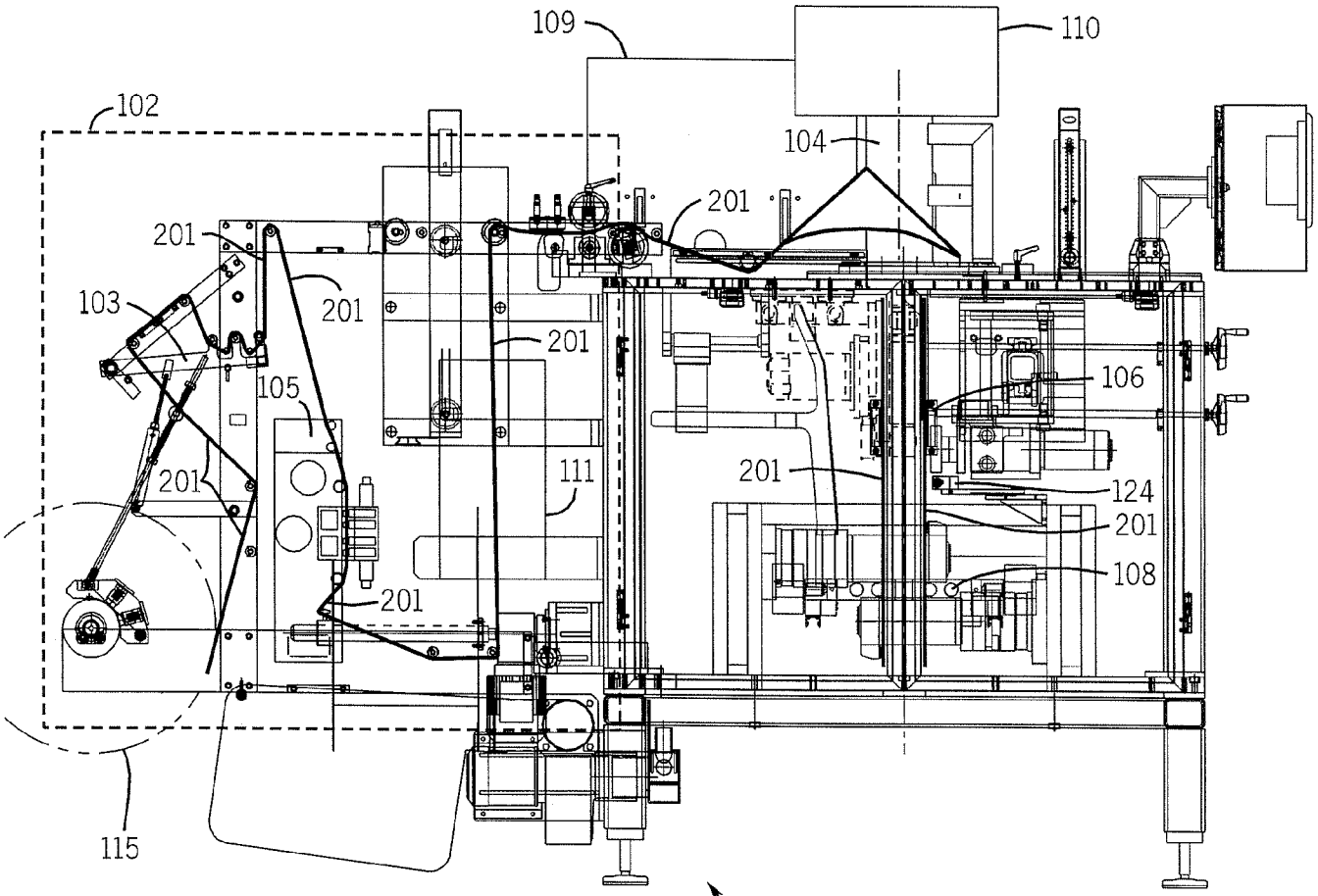
FIG. 1 is a side view of a continuous, vertical form, fill and seal packaging machine in accordance with the preferred embodiment.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular vertical form fill and seal machine used in a particular way, it should be understood at the outset that the invention can also be implemented with other machines used in other ways.

Generally, the preferred embodiment of the invention provides for a continuous, vertical form, fill and seal packaging machine that pleats the film, and seals the pleat, prior to the film reaching a forming tube. Also, a hole punch is provided after the film has been formed into a tube, to provide a hanger hole for the film. The invention may be implemented using known prior art technology for the remainder of the machine. For example, the preferred embodiment is similar to a CMD Corp CM300® continuous, vertical form, fill and seal packaging machine, but with the changes described generally above. Alternative embodiments include an intermittent vertical, form, fill and seal packaging machine.

The pleats are formed or imparted to the film and sealed in a pleat assembly in the preferred embodiment. The pleat assembly is located in the infeed section (the section from the roll of film to the forming tube), and the film is provided to the pleat assembly from the unwind roll. The pleat assembly forms two pleats in the preferred embodiment. Each pleat is formed by the action of a moveable shoe, and an angled fixed (or dead) plate (collectively called a pleater). Pleater, as used herein, includes the components acting together to form a pleat. The film is pulled along the dead plate until reaching the shoe. The amount of film pulled is half of the depth of the pleat. The film is driven by rolls at the center (cross-direction) of the film, so that the edges of the film are free to be drawn inward as the pleat is formed.

The pleat is easily adjusted by the user without reconfiguring the machine. The pleat depth is adjusted by adjusting the position of the shoe relative to the angled dead plate, the distance between the pleats is adjusted by adjusting the distance between pairs of shoes and dead plates. The cross machine location of the pleats is adjusted by adjusting the cross machine location of both pleaters. The adjustments are made by turning knobs connected via gears to mounting plates for the shoes and dead plates.

The film travels from the pleat assembly to a sealing zone, where radiant heat is used to heat the film and impart a seal. The radiant heat seals the film, which is preferably a PET film having a 48 gauge thickness (100 gauge=1 mil=0.001 inch), with a co-extruded sealant layer 2-3 mils thick (for example, an LLDPE, HDPE, or ME or combinations thereof for the sealant layer). Other films and film thicknesses may be used. A backing plate is provided to help create a "heat chamber" through which the pleated film passes.

The preferred embodiment further provides for a hole punch assembly to be mounted between the forming tube and the horizontal seal bars (it is mounted in other locations in other embodiments). The hole punch is preferably synchronized to the horizontal seal bars to form a single hole per pouch. The hole punch must be fast enough to punch the hole at speed the machine will run, and is a D30 punch unit from MAL Ltd., in the preferred embodiment. The hole punch creates a hanging chad (to avoid the mess of punched chads) and leaves the leading 25% of the chad attached, so the chad is pressed back into the hole from which it was formed as the pouch moves downstream. Alternative embodiments provide for different shaped holes, multiple holes, removed chads, or chads attached differently.

Referring now to FIG. 1 a continuous, vertical form, fill and seal packaging machine 100 in accordance with the preferred embodiment is shown. It operates generally as the prior art CMD Corp. CM 300® operates, with the changes described below. The preferred embodiment includes a machine that makes only pouches, but it could be implemented on a machine with rotatable, a quick change unit, or a traditional change unit, to also make pillow bags or other style packages. Also, the preferred embodiment includes a continuous machine, but alternatives include intermittent machines. Before describing the differences between the preferred embodiment and the prior art, the common features will be briefly described.

Generally, the film is unwound from a roll by infeed section 102, passes through a dancer assembly 103, a gusset hole punch 105, and provided to a forming tube 104. A vertical seal assembly 106 creates a continuous vertical seal. Forming tube 104 includes a tucker bar and plough assembly that form a gusset in accordance with the prior art. After the gusset is formed a horizontal seal is created with horizontal seal assembly 108. A scale assembly 110 drops a measured amount of product through the forming tube, filling the pouch, after each horizontal seal is made. It may also have other known features such as notching assembly 109 for notching a zipper.

Continuous, vertical form, fill and seal packaging machine 100 includes, unlike the prior art, a pleating/sealing assembly 111, which includes a pleat assembly 120 (FIG. 2), a pleat sealer 122 (FIG. 2) and a hole punch assembly 124. A single machine controller controls the new and old operations to accurately synchronize the entire process. The operation of pleat sealer 122 is generally described above, and will be described in more detail below. A film 201 is shown having a path from a film roll 115, to dancer assembly 103, to gusset hole punch 105, to pleating/sealing assembly 111, to forming tube 104, past vertical seal assembly 106, to hole punch assembly 124 and then to horizontal seal assembly 108. A zipper notch assembly 109 is also shown.

While the preferred embodiment is shown using a vertical machine, it is also contemplated using the invention on a horizontal machine. For example, notch assembly 109 (as well as other features herein) may be readily adapted to a horizontal machine.

Notch assembly 109 may be constructed in accordance with the prior art. However, prior art systems result in slippage of one side of the zipper or other closure mechanism relative to the other this slippage maybe caused by a number of different reasons. As the film is pulled over idler rolls, the side of the zipper or other closure mechanism in contact with the idler roll has more friction, and will be pulled back more than the non-contact side. When this occurs after the notch has been created, the notch becomes effectively smaller because the start of the contact side of the zipper is offset from the start of the non-contact side. For example, if the notch is one inch, and the contact side is offset ⅜ of an inch, the notch will be only ¼ inch—where the contact side notch overlaps with the non-contact side notch.

One embodiment provides for bonding the upper zipper or other closure mechanism and the lower zipper or other closure mechanism to prevent slippage. The bonding can be done in any manner, such as with thermal bonding, gluing, tacking or crushing, ultrasonic, laser, embossing, pressure sealant/cold sealant, electrostatic pinning, fibers, etc. The bonding helps reduce slipping of the contact side relative to the non-contact side, and thus reduces narrowing of the notch. The bonding is preferably done on the zipper, not the flanges, although it may be done on the flanges in various embodiments. As with other features of this invention, it may be implemented in a vertical or horizontal arrangement.

Figure 2:
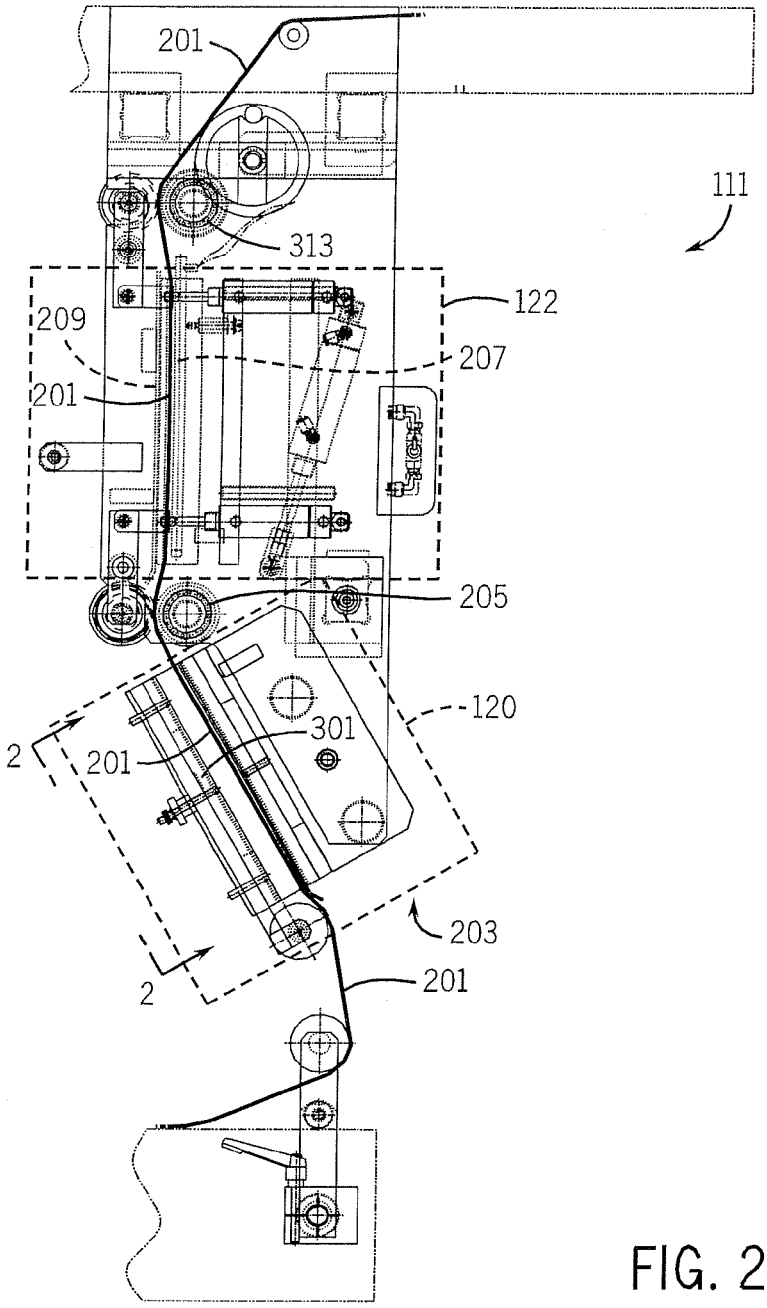
FIG. 2 is a side view of a sealing/pleating assembly of FIG. 1.

Referring now to FIG. 2, a side view of pleat/seal assembly 111, including assembly 120 and pleat sealer 122, is shown. A film 201 moves through these assemblies in a generally upward direction, as shown by arrow 203. Film 201 passes through pleat assembly 120 and is driven by rolls in the center of film 201 to allow the film edges to be drawn in by a pleater 301.

Figure 3:
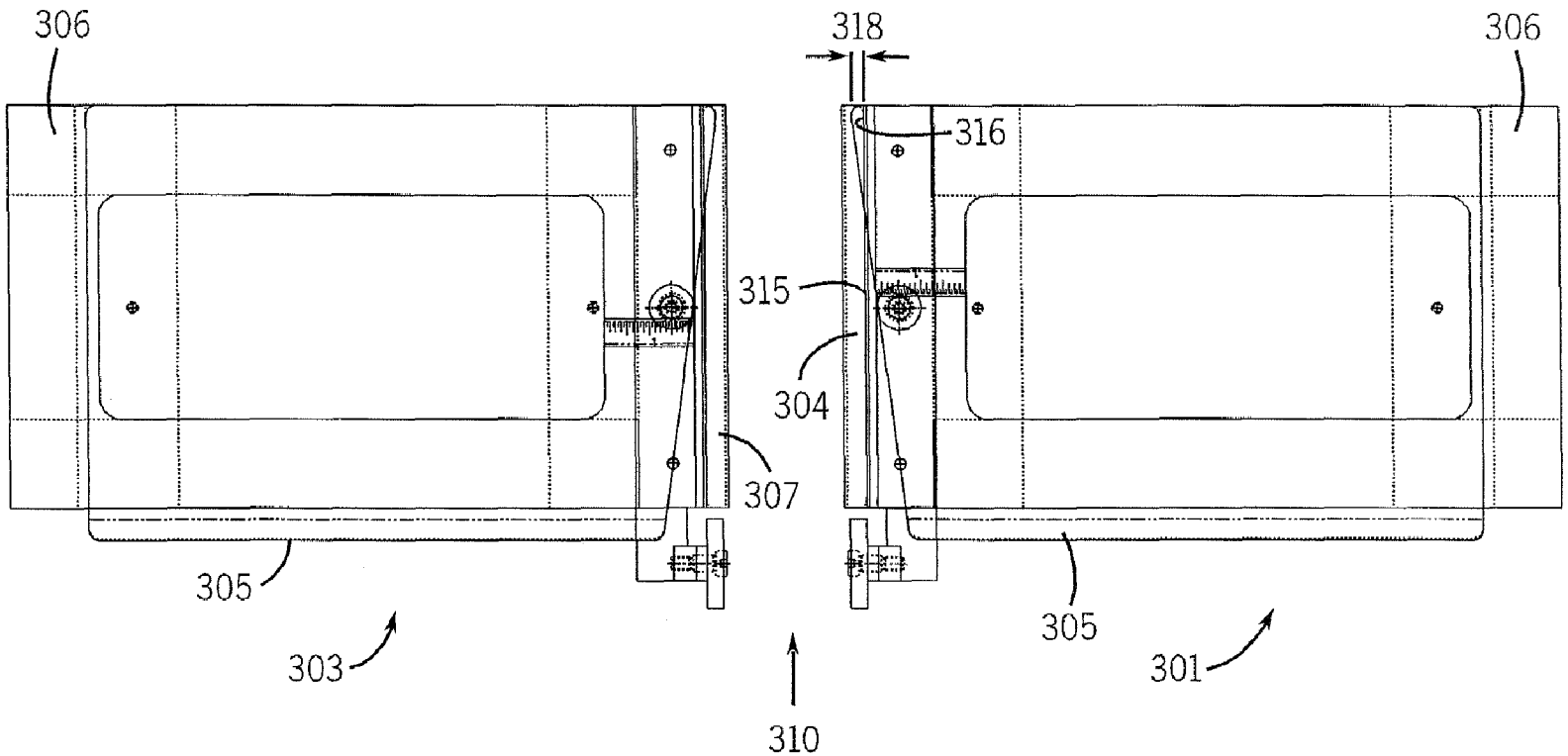
FIG. 3 is a side view of a pleater of FIG. 2, taken along section 2-2.
Figure 4:
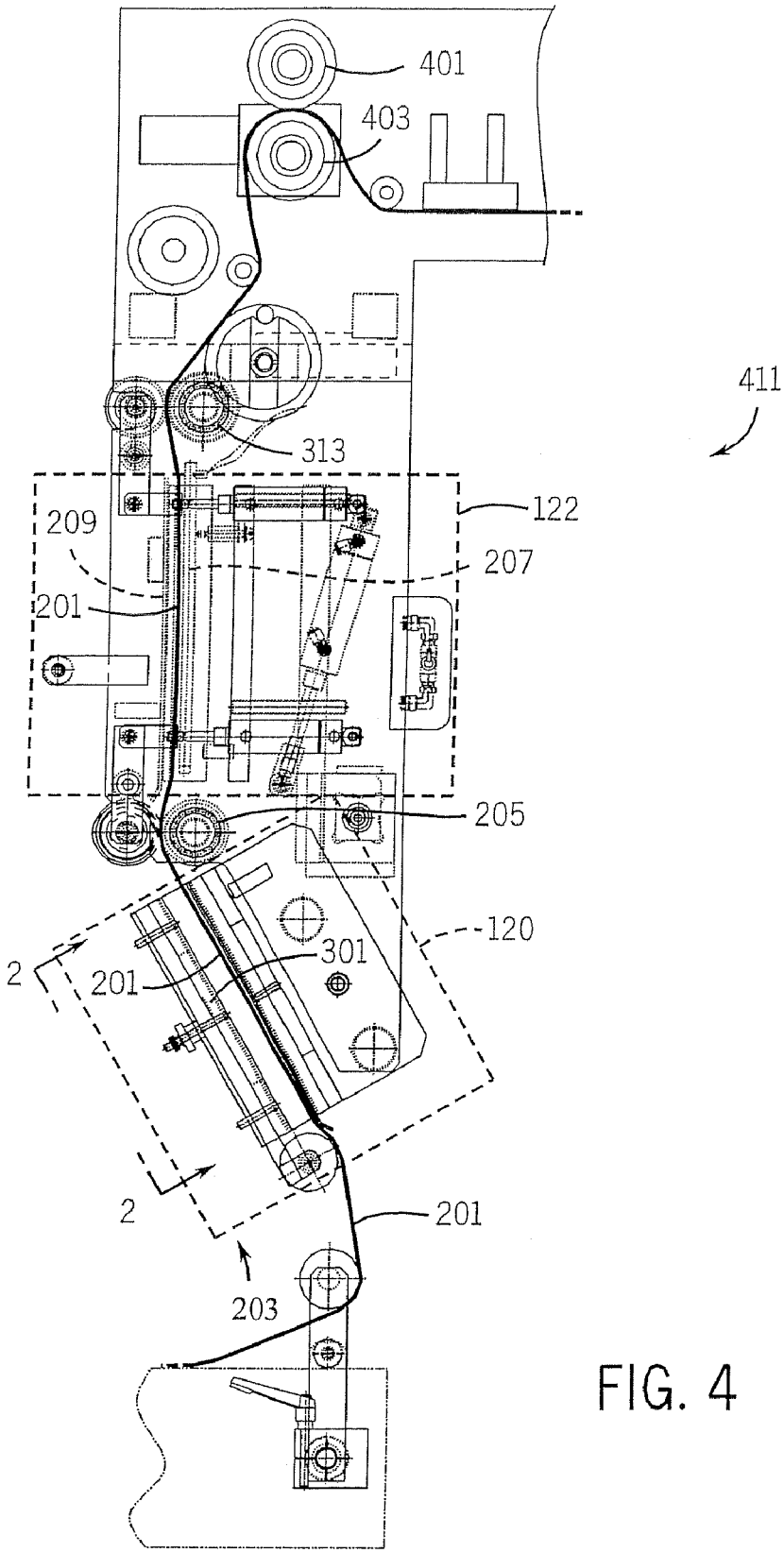
FIG. 4 is a side view of an alternative sealing/pleating assembly of FIG. 2, taken along section A-A 2-2.

Pleater 301 is shown in FIG. 3, along with a pleater 303. FIG. 3 is a view taken along lines 2-2 of FIG. 2. Pleater 301 includes a moveable shoe 304, a fixed plate 305 and a mounting plate 306. Moveable shoe 304 is generally rectangular, and fixed plate 305 is angled along an edge 316 where the pleat is formed. The film moves in the direction of arrow 310, and the pleat is formed by drawing the film inward from where an edge 315 of dead plate 305 crosses angled edge 316 of shoe 304. The film is drawn in and pleated until the upper edge of shoe 304 is reached. Thus, the depth of the pleat is a distance 318, from edge 316 to the center most (center in the cross machine direction) part of edge 315. Moving shoe 304 towards the center decreases the pleat depth and moving shoe 304 away from the center increases the pleat depth. Shoe 304 is connected to a user-adjustable knob at the side of continuous, vertical form, fill and seal packaging machine 100 to allow the user to easily adjust the depth of the pleat.

Pleater 303 has a mirror image design, and operates in a similar manner. The two pleats can be adjusted to have different depths by unequally adjusting shoes 304 and 307.

Pleaters 301 and 303 are mounted on plates that may be moved in the cross machine direction to adjust the position of the pleats relative to one another. Using two adjustments, one for the distance between them, and the other for left to right adjustment, they can be adjusted to virtually any cross machine direction. These adjustments can be made easily by turning a few knobs, and without changing the machine setup or swapping parts in and out.

The preferred embodiment provides for a pleat depth (i.e., the distance the pleat extends from the flat surface) of between ⅛ to ¼ inch, and other distances are provided in alternative embodiments. The preferred embodiment further provides for an adjusted distance between pleats of 1 inch to 4.25 inches, centered about the midline of the film. Other adjusted distances may be provided. For example, if the pleats are slightly off center, the pouch will tip on display, for shingling or viewing.

Referring again to FIG. 2, after the pleat is formed a tension roll 205 is provided which helps prevent the pleats from opening. Film 201 then travels to pleat sealing assembly 122. Pleat sealing assembly 122 includes a radiant heater 207 (which is two vertical heat bars, each aligned with a pleat, in the preferred embodiment), and a backing plate 209. Backing plate 209 helps form a heat chamber to hold heat in so that the seal is properly made. Preferably, backing plate 209 is disposed to just touch film 201, and is Teflon® coated to avoid sticking. The preferred film has adhesive on only one side (the sides that touch when the pleat is formed). When the process is stopped, heater 207 can be tilted back to avoid applying heat to the stopped film. Also, in the preferred embodiment, the heat is applied in a low or no tension area, to reduce the likelihood of sticking. Alternative embodiments include running the film on a cushion of air to reduce friction (in the sealing or pleating areas), and/or using other devices to make the seal, such as ultrasonic or infrared heaters.

After the pleats are sealed, pleated film 201 passes over a large diameter roll 313 that cools the heated film. Roll 313 is passively cooled, although it could be actively cooled. The large diameter also provides tension to help hold the pleats in place. Following large diameter roll 313, the film can be turned by a small diameter roll, because the pleat seals have been set.

One advantage of forming the pleats prior to forming the film tube is that the gusseting is a much easier and more natural process with pleated film, compared to flat film.

Another advantage is the system could intermittently apply pleats, if so desired. If a pleat is large enough, the web is narrower at the forming tube, thus the machine can be designed with this in mind. For example, for two pleats, each 0.25 inches deep, the web will be 1 inch narrower after the pleats are formed.

The film is then provided to forming tube 104. Preferably the forming collar is gently sloped, to accommodate the pleats. The preferred forming tube has a cut away section toward the bottom of the forming tube with ploughs aligned with the pleats to form the gusset. As stated above, a pleated film makes forming a gusset less difficult because it helps locate the film in the proper position. Preferably, the pleats stabilize the process so that it is more readily repeatable, and reduces the need for fine tuning the machine when setting it up. The preferred embodiment runs at about a hundred bags a minute, although greater or lesser throughputs are contemplated, as is intermittent operation.

The film is pulled over the forming collar and down the forming tube by pull belts. The multi-layer film (from the pleats) requires greater tension to pull than a single layer film, so the vertical pull belt is provided with larger holes and vacuum pockets to help grip the film. Preferably the holes are 5/32 inches in diameter, and the vacuum pockets are ¼ inch wide, 1 inch long, and ⅛ inch deep, and set at a 45 degree angle relative to the machine direction. A gear box with a 5:1 ratio provides the increased torque needed to pull the film over the collar and maintain the desired registration.

An alternative embodiment entails using a collar having a cut-out where the pleats are. This reduces the tension needed to pull the film but reduces the adjustability, since the pleats must line up with the cut-outs.

Hole punch assembly 124 is disposed below forming tube 104 and above the horizontal seal assembly 108, and located to punch a generally circular hole in the vertical seal (the opposite end of the pouch from the gusset). The punch preferably leaves a hanging chad, roughly attached along the leading quarter-edge, so that chads do not create a mess, and the chad lays flat after being created. The punch is synchronized with horizontal seal assembly 106 so that one hole per pouch is made, and it is located midway along the top (after the pouch is rotated so the vertical seal is at the top). Alternatives include removing the chad, punching multiple holes, leaving the chad attached in different locations, and holes that have other shapes.

The above described embodiment has one mechanism driving or pulling the film—the vacuum pull belt. In some circumstances the pleat assembly and pleated film will have drag such that additional driving of the film is desirable. Thus, an alternative pleat/seal assembly 411 is shown in FIG. 2, and is similar to assembly 111, but includes a pair of servo driven rolls 401 and 403 that form a servo driven nip through which film 201 passes. Other types of driven rolls may be used. The driven nip is preferably used to measure the film for a particular bag length (and thus also a measured driven nip). Thus, the vacuum pull belt merely needs to pull the film to keep sufficient tension.

Numerous modifications may be made to the present invention which still fall within the intended scope hereof. Thus, it should be apparent that there has been provided in accordance with the present invention a method and apparatus for continuous, vertical form, fill and seal packaging that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A vertical, form, fill and seal packaging machine, comprising:

an infeed section disposed to provide a film;

a pleating assembly, disposed to impart at least one pleat to the film;

a driven nip through which the film passes after the pleating assembly;

a closure notching assembly, disposed to receive the film after it passes through the driven nip;

a forming tube, disposed to receive the film from the closure notching assembly, and about which a film tube is formed, and from which the film tube is vertically fed downward; and a sealing assembly, disposed to receive the film tube from the forming tube, and disposed to impart seals to the film tube, thereby forming packages.

2. The vertical, form, fill and seal packaging machine of claim 1, wherein the pleating assembly is part of the infeed section, and wherein the infeed section is a continuous infeed section.

3. The vertical, form, fill and seal packaging machine of claim 2, wherein the infeed section further comprises a pleat sealing assembly disposed to receive the film after it passes through the pleating assembly and further disposed to seal the at least one pleat prior to the film being received by the driven nip.

4. The vertical, form, fill and seal packaging machine of claim 3, wherein the pleating assembly further comprises a user controlled pleat depth adjustment operatively connected to the pleating assembly.

5. The vertical, form, fill and seal packaging machine of claim 4, wherein the pleating assembly further comprises a user controlled crossmachine pleat location adjustment operatively connected to the pleating assembly.

6. The vertical, form, fill and seal packaging machine of claim 5, wherein the pleating assembly further comprises at least two pleaters, whereby at least two pleats are imparted to the film by the pleating assembly.

7. The vertical, form, fill and seal packaging machine of claim 6, further comprising a hole punch assembly disposed to punch a hole in the film, and further disposed to receive the film after the film reaches the forming tube.

8. The vertical, form, fill and seal packaging machine of claim 1, wherein the driven nip is a measured driven nip.

9. A method of vertically, forming, and sealing packages, comprising:

feeding film;

imparting at least one pleat to the film;

attaching a closure to the film and forming a notch in the closure;

measuring a length of the film after the pleat has been imparted;

providing the measured film to a forming tube and imparting a vertical seal to the film, thereby forming a film tube; and applying a series of horizontal seals, thereby forming packages.

10. The method of claim 9, further comprising intermittently providing product through the forming tube, to fill each package between the horizontal seals.

11. The method of claim 10, further comprising sealing the at least one pleat.

12. The method of claim 11, further comprising adjusting a pleat depth in response to a user controlled pleat depth adjustment.

13. The method of claim 12, further comprising adjusting a crossmachine location of the pleat location in response to a user controlled cross-machine direction pleat location adjustment.

14. The method of claim 13, further comprising imparting at least a second pleat.

15. The method of claim 14, further comprising intermittent punching of the film, wherein the intermittent punching is synchronized with the horizontal sealing to form one hole for each package.

16. The method of claim 9, wherein measuring includes measuring and driving.

17. A vertical, form, fill and seal packaging machine, comprising:

means for feeding film;

means for imparting at least one pleat to the film;

means for attaching a closure to the film and forming a notch in the closure, disposed to receive the film from the means for imparting;

means for measuring a length of the film after the pleat has been imparted;

means for forming a film tube and for feeding the film tube vertically downward, disposed to receive film from the means for measuring; and sealing means for receiving the film tube from the forming means and for sealing the film tube, thereby forming packages.

18. The vertical, form, fill and seal packaging machine of claim 17, further comprising means for sealing the at least one pleat, disposed to receive the film after it passes through the means for imparting and before the film is received by the means for measuring.

19. The vertical, form, fill and seal packaging machine of claim 17, further comprising a user controlled means for adjusting a pleat depth operatively connected to the means for imparting.

20. The vertical, form, fill and seal packaging machine of claim 17, further comprising a user controlled means for adjusting a crossmachine direction pleat location operatively connected to the means for imparting.

21. The vertical, form, fill and seal packaging machine of claim 17, wherein the at least one seal is two or more seals.

22. The vertical, form, fill and seal packaging machine of claim 21, further comprising a user controlled means for adjusting pleat separation operatively connected to the means for imparting.

23. The vertical, form, fill and seal packaging machine of claim 22, further comprising means for punching a hole in the film, and disposed to receive the film after the film reaches the means for forming.

24. The vertical, form, fill and seal packaging machine of claim 22, wherein the means for measuring also is a means for driving the film.

25. A vertical, form, fill and seal packaging machine, comprising:

means for feeding film;

means for imparting at least one pleat to the film;

means for attaching a closure to the film and forming a notch in the closure, disposed to receive the film from the means for imparting;

means for driving the film after the pleat has been imparted;

means for forming a film tube and for feeding the film tube vertically downward, disposed to receive film from the means for driving.

* * * * *